US006264313B1

(12) United States Patent
Mackowiak et al.

(10) Patent No.: US 6,264,313 B1
(45) Date of Patent: Jul. 24, 2001

(54) FLUID DELIVERY MANIFOLD AND METHOD OF MANUFACTURING THE SAME

(75) Inventors: Stephen P. Mackowiak, Gardner; Robert Sheehy, North Attleboro, both of MA (US); Glenn E. Kisch, Nashua, NH (US)

(73) Assignee: Nypro, Inc., Clinton, MA (US)

( * ) Notice: Subject to any disclaimer, the term of this patent is extended or adjusted under 35 U.S.C. 154(b) by 0 days.

(21) Appl. No.: 09/570,979

(22) Filed: May 15, 2000

Related U.S. Application Data

(60) Provisional application No. 60/153,450, filed on Sep. 10, 1999.

(51) Int. Cl.[7] ..... B41J 2/175
(52) U.S. Cl. ..... 347/85
(58) Field of Search ..... 347/84, 85, 86, 347/87; 264/5, 250, 263

(56) References Cited

U.S. PATENT DOCUMENTS

| | | | |
|---|---|---|---|
| 3,458,619 | 7/1969 | Prochaska . | |
| 3,476,852 | 11/1969 | Shattuck . | |
| 4,155,478 | 5/1979 | Ogi | 220/4 B |
| 4,261,947 | 4/1981 | Ogi | 264/263 |
| 4,304,749 | 12/1981 | Bauer | 264/263 |
| 4,312,687 | 1/1982 | Sigworth, Jr. | 156/245 |
| 4,544,588 | 10/1985 | Schauf | 428/35 |
| 5,297,336 | 3/1994 | Burolla | 29/890.1 |
| 5,464,578 | 11/1995 | Salter et al. | 264/250 |
| 5,472,655 | 12/1995 | Morita | 264/245 |
| 5,651,998 | 7/1997 | Bertschi et al. | 425/127 |
| 5,756,029 | 5/1998 | Nakamichi et al. | 264/161 |
| 5,874,978 | 2/1999 | Swanson et al. | 347/87 |
| 5,886,720 * | 3/1999 | Sasaki | 347/86 |
| 5,906,703 | 5/1999 | Kriesel | 156/275.1 |
| 5,924,198 | 7/1999 | Swanson et al. | 29/890.1 |
| 5,962,794 | 10/1999 | Kriesel et al. | 73/861.47 |
| 5,969,738 * | 10/1999 | Tomikawa et al. | 347/86 |
| 5,985,153 | 11/1999 | Dolan et al. | 210/695 |
| 5,992,769 | 11/1999 | Wise et al. | 239/548 |
| 5,993,665 | 11/1999 | Terstappen et al. | 210/69 |
| 6,013,188 | 1/2000 | Terstappen et al. | 210/695 |

FOREIGN PATENT DOCUMENTS

| | | | |
|---|---|---|---|
| 0 469 916 A1 | 2/1992 | (EP) | B41J/2/16 |
| 0 913 241 A1 | 5/1999 | (EP) | B29C/45/14 |

OTHER PUBLICATIONS

Patent Cooperation Treaty International Search Report PCT/US00/24256 Dec. 28, 2000.

* cited by examiner

*Primary Examiner*—N. Le
*Assistant Examiner*—Anh T. N. Vo
(74) *Attorney, Agent, or Firm*—Bromberg & Sunstein LLP

(57) ABSTRACT

A fluid delivery manifold and a method of manufacturing a fluid delivery manifold is provided. A first manifold portion having a contoured interior face is set in registry with a second manifold portion having a contoured interior face to form an uncoupled manifold having a plurality of fluid inlets and a plurality of fluid outlets. The contoured interiors of the first and second manifold portions form a plurality of material channels and a plurality of fluid channels in the uncoupled manifold. A second shot material is injected into the material channels to couple the first and second manifold portions and to compensate for any variation or differences between the pitch of the fluid inlets and fluid outlets.

17 Claims, 9 Drawing Sheets

FLUID DELIVERY MANIFOLD AND METHOD OF MANUFACTURING THE SAME

PRIORITY

This application claims priority from provisional U.S. patent application Ser. No. 60/153,450, filed Sep. 10, 1999 entitled, "Fluid Delivery Manifold and Method of Manufacturing the Same" and bearing attorney docket number 1600/120, the disclosure of which is incorporated herein, in its entirety, by reference.

TECHNICAL FIELD

The invention relates generally to fluid delivery systems, and, more particularly, the invention relates to a multiple path fluid delivery manifold.

BACKGROUND ART

Fluid delivery systems are employed in a wide variety of technologies to deliver a fluid with precision. Among other things, such systems are used to deliver medications intravenously, dispense chemical agents, and propel paints and inks onto a surface. For example, fluid delivery systems are often used in ink jet printers commonly used with home computers. Such fluid delivery systems generally have several fluid discharge outlets that are spaced apart from one another at equal distances, and several fluid inlets that distribute ink to the discharge outlets.

In one common design of color ink jet printers, the ink is supplied in a cartridge. The cartridge generally has two pieces of plastic welded together at the outer perimeter. The cartridge usually includes a container of black ink and several smaller containers of colored ink. The containers are arranged linearly within the cartridge. The container of black ink is, optimally, a greater volume than the colored inks because black ink is used more often than colored ink. Accordingly, at the respective inlets, the distance between the several containers of colored ink generally is smaller than the distance between the colored inks and the container of black ink. Consequently, in such cartridges, the fluid inlets are not evenly spaced apart. Unlike the fluid inlets, the fluid outlets are generally spaced apart at equal distances to ensure that the ink is applied evenly to the paper.

In those cartridges where the spacing between the inlets is variable and the spacing between the outlets is uniform, the channels between the respective inlets and outlets typically are not straight. In fact, the channels can be configured to be very long and tortuous. Such long channels increase the difficulty of effectively manufacturing the cartridge. If a channel is not properly constructed, ink from such channel (e.g., the channel with black ink) undesirably can leak into the other channels.

SUMMARY OF THE INVENTION

In accordance with one aspect of the invention, a method for manufacturing a fluid delivery manifold utilizes a second shot material injection to couple manifold portions. In particular, a first manifold portion and a second manifold portion are set in registration to form an uncoupled manifold. The first and second manifold sections each have a contoured interior face. The contoured interiors of the first and second manifold portions form a plurality of material channels and a plurality of fluid channels. The uncoupled manifold also has a plurality of inlets at a first pitch and a plurality of outlets at second pitch. A second shot material is injected into the material channels. The second shot material couples the first and second manifold portions of the uncoupled manifold to the seal the fluid channels.

In another embodiment of the invention, the first manifold portion is provided using a first shot procedure. A molding device having a center rotating plate with a first face is provided. A first shot procedure is performed forming manifold portions on the first face of the rotating plate. In a further embodiment, a robotic arm rotates the center plate and removes a second manifold portion from the rotating plate and positions the second manifold portions in registration with a first manifold portion.

In accordance with a further aspect of the invention, a fluid delivery manifold includes a first manifold portion, a second manifold portion, and a sealing bead. The sealing bead couples the first manifold portion to the second manifold portion to form a coupled manifold. The coupled manifold forms a plurality of material channels and a plurality of fluid channels. The coupled manifold also includes a plurality of inlets at a first pitch and a plurality of outlets at a second pitch. The sealing bead is formed by injecting a second shot material into the plurality of material channels.

In another embodiment, a method of manufacturing a fluid delivery manifold is provided. The method includes positioning a first manifold portion in registration with a second manifold portion to form an uncoupled manifold. The uncoupled manifold has a plurality of material channels and a plurality of fluid channels. The uncoupled manifold also has a plurality of fluid inlets and a plurality of fluid outlets, where the fluid outlets are at a different pitch than the fluid inlets. A second shot material is injected into the material channels to seal the fluid channels and form a coupled manifold.

In other embodiments of the invention, the first pitch of the manifold is variable and the second pitch is uniform. In still further embodiments, the first shot material is different from the second shot material. The second shot material may be glass filled polyester.

DETAILED DESCRIPTION OF SPECIFIC EMBODIMENTS

In a preferred embodiment of the invention, a method for manufacturing a fluid delivery manifold sets two manifold portions in registry to form an uncoupled manifold. Among other things, the uncoupled manifold has fluid inlets that are not uniformly spaced apart, and corresponding fluid outlets are uniformly spaced apart. In addition to the inlets and the outlets, the uncoupled manifold has a plurality of (uncoupled) fluid channels that each couples one fluid inlet with one fluid outlet. Once the uncoupled manifold is formed, a second shot material is injected into material channels within the uncoupled manifold to couple the two manifold portions. In addition to coupling the two manifold portions, use of the second shot material reduces the likelihood that fluid will leak between the fluid channels. Details of the both process of manufacturing the manifold, and the manifold itself are discussed below.

Figure 1:
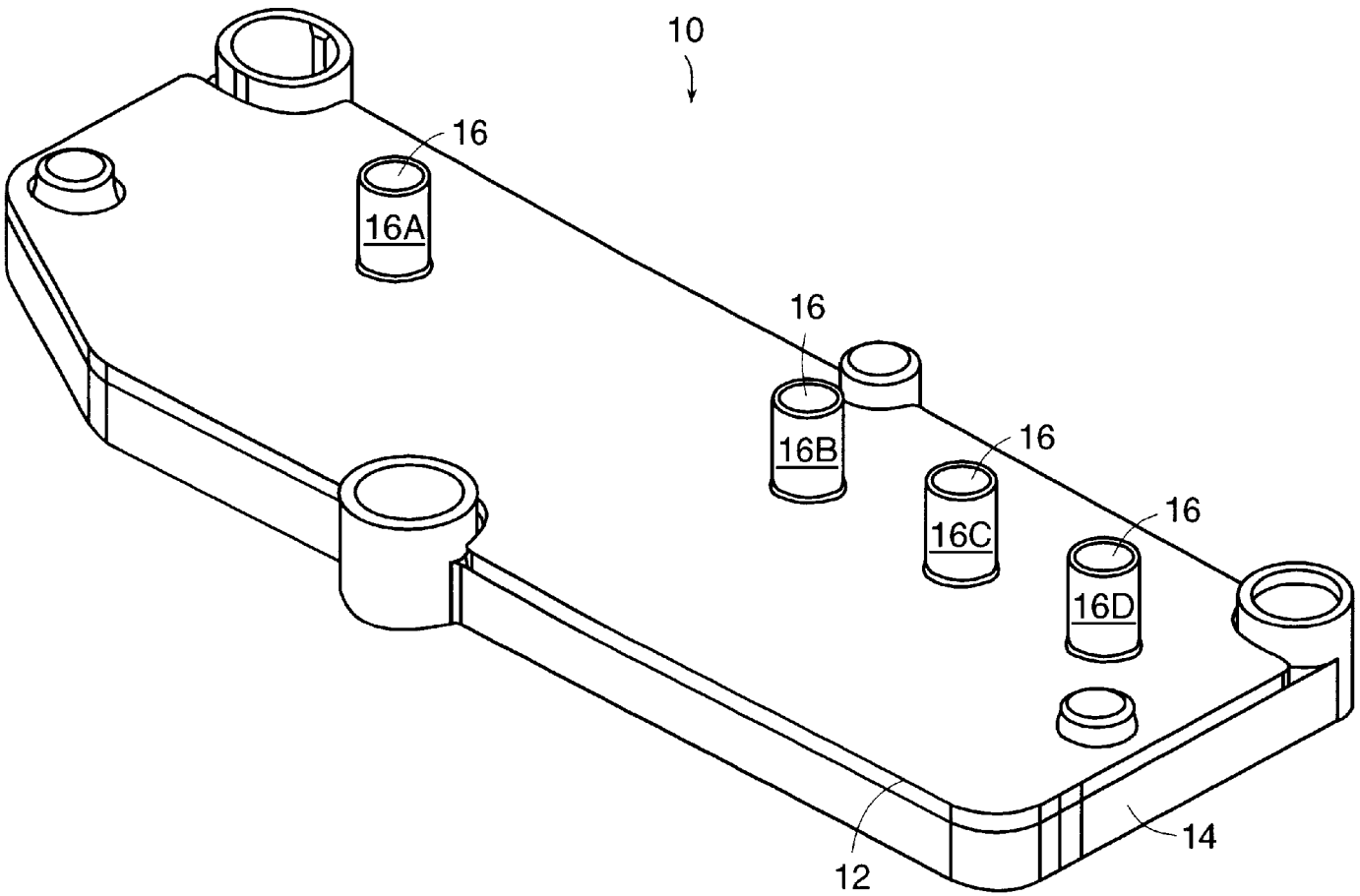
FIG. 1 is a perspective view of a fluid delivery manifold according to one embodiment of the present invention.

FIG. 1 schematically shows a perspective view of a fluid delivery manifold manufactured in accordance with illustrative embodiments of the invention. The fluid delivery manifold 10 includes a first manifold portion 12 with a plurality of fluid inlets 16, and a second manifold portion 14 with a plurality of fluid outlets 32 (shown in FIG. 3). As noted above and below, prior to assembly, the manifold portions 12 and 14 are set in registry to form an uncoupled manifold.

In illustrative embodiments, the fluid inlets 16 variably "pitched" (defined below) from one another. Unlike the fluid inlets 16, however, the fluid outlets 32 are uniformly pitched. Specifically, as known in the art, the term "pitch" refers to the distance between two specified inlets, or two specified outlets. For example, the manifold 10 shown in FIG. 1 includes fluid inlets 16A, 16B, 16C, and 16D. The distance (i.e., the pitch) between fluid inlets 16A and 16B is different than the distance (i.e., the pitch) between fluid inlets 16B and 16C. In fact, in illustrative embodiments, the distance between fluid inlets 16C and 16D is substantially identical to the distance between the fluid inlets 16B and 16C.

Figure 3:
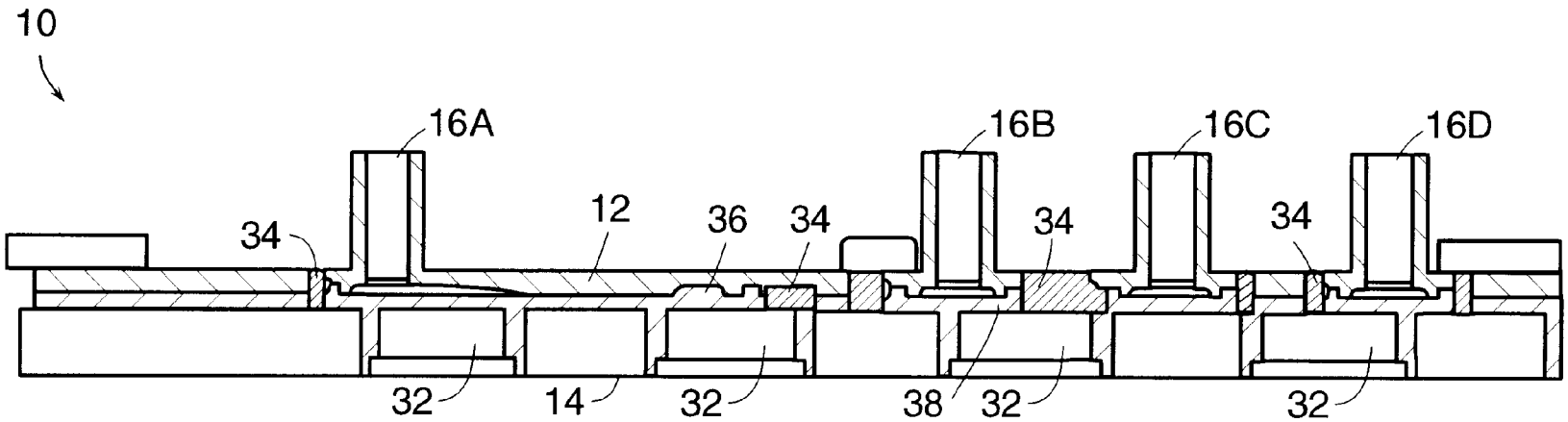
FIG. 3 is a cross sectional view along line 3—3 of the manifold shown in FIG. 2.

Accordingly, since the fluid inlets 16A–16D are not uniformly spaced, they are referred to herein as being "variably pitched." In contrast, the fluid outlets 32 are referred to herein as being "uniformly pitched" because they are evenly spaced apart (see FIG. 3). The first pitch may be variable for a number of reasons. For example, when used to deliver ink for inkjet printers, the fluid inlets 16A–16D may be variably pitched to accommodate varying sizes of ink containers, while the fluid outlets 32 may be uniformly pitched to simplify the processes of applying ink to a page.

The manifold portions 12 and 14 are formed by conventional injection molding process to have contoured inner faces 36 and 38 (FIG. 3) with a plurality of grooves. When the two manifold portions 12 and 14 are set in registry to form the uncoupled manifold, the contours on the inner faces 36 and 38 cooperate to form a plurality of fluid channels 42 (noted above, see FIG. 4) that each couples one fluid inlet 16 with one fluid outlet 32. In addition to forming the fluid channels 42, the contours on the inner faces 36 and 38 also cooperate to form a plurality of material channels 18 (also noted above) that accept second shot material for coupling the manifold portions 12 and 14. In illustrative embodiments, the second shot material is injected into the material channels 18 via a plurality of material channel inlets 17 (FIG. 2), thus coupling the two manifold portions 12 and 14 to form the final manifold 10.

Figure 2:
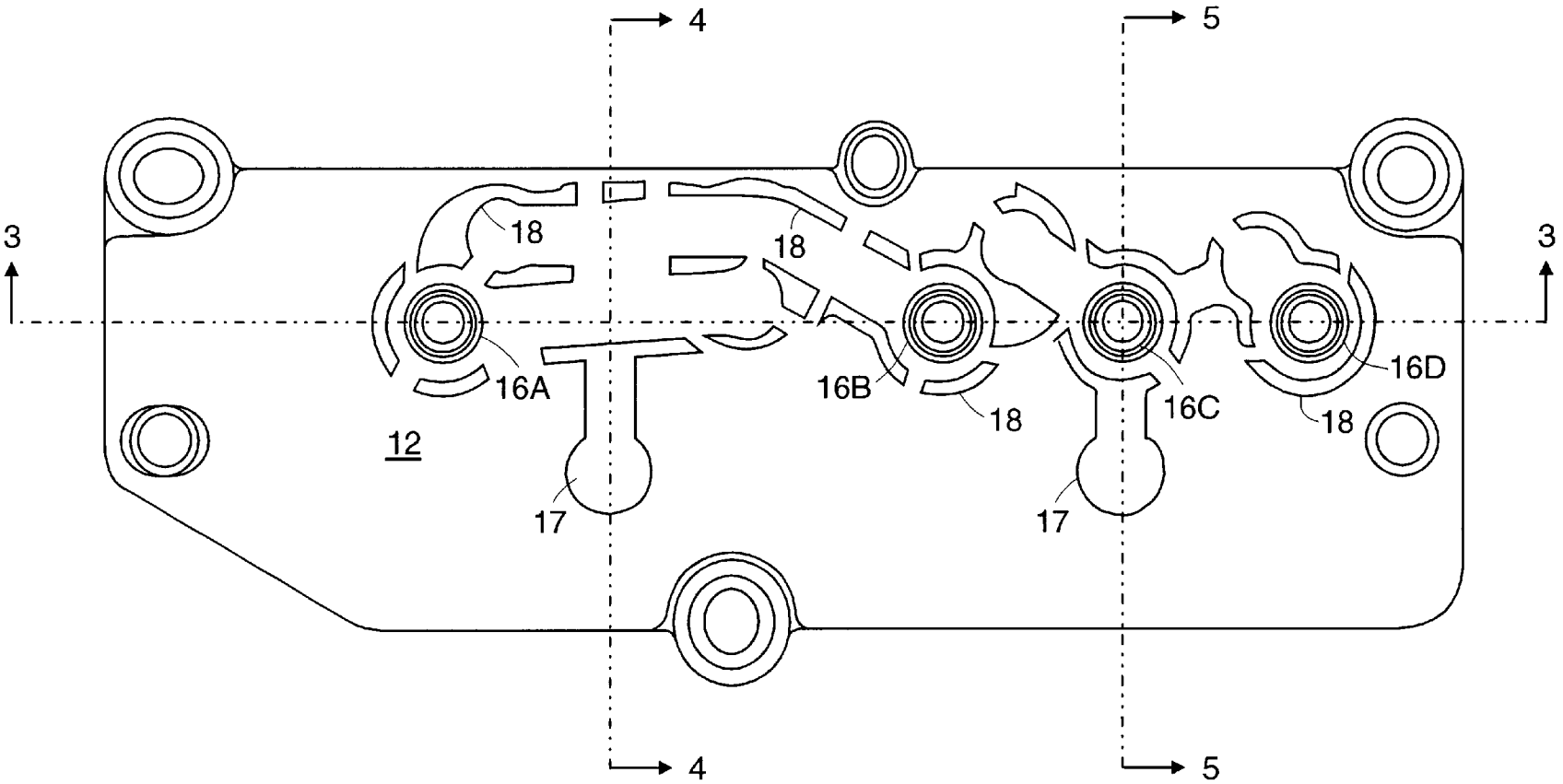
FIG. 2 is a plan view of the fluid delivery manifold shown in FIG. 1.

FIG. 2 is a plan view of the coupled fluid delivery manifold 10 shown in FIG. 1. Among other things, FIG. 2 shows an outline of various orifices/grooves 18 that receive the second shot material. Specifically, prior to receiving the second shot material, the first manifold portion 12 has a plurality of orifices 18 that are open to its top surface. Accordingly, in addition to filling the material channels 18 that are not readily visible from the exterior of the first manifold portion 12 (i.e., internal material channels 18), the second shot material fills these visible orifices 18 to be substantially flush with the top surface. Of course, these orifices include the material inlets 17.

Figure 4:
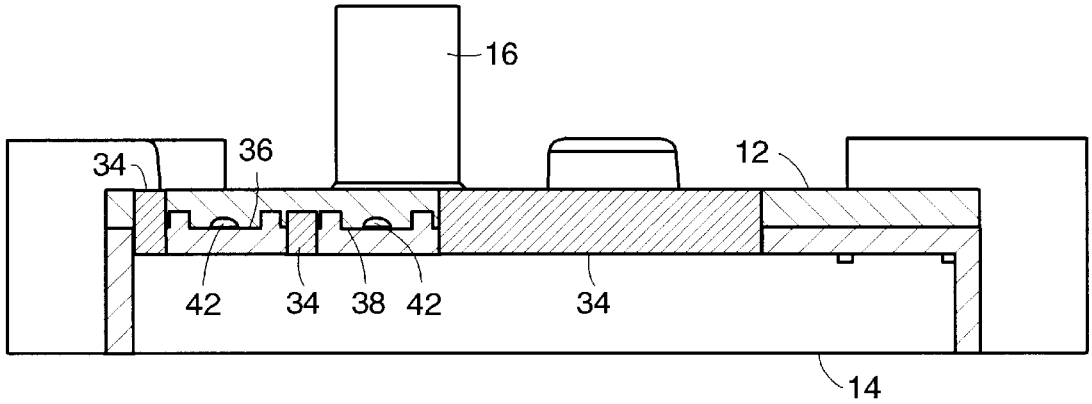
FIG. 4 is a cross sectional view along line 4—4 of the manifold shown in FIG. 2
Figure 5:
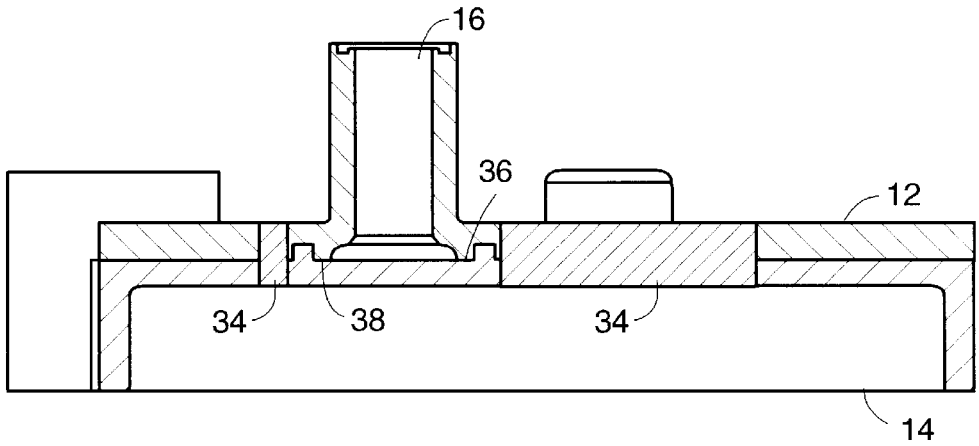
FIG. 5 is a cross sectional view along line 5—5 of the manifold shown in FIG. 2.

FIG. 3 is cross-sectional view taken along the line 3—3 of FIG. 2, FIG. 4 is a cross- sectional view taken along the line 4—4 of FIG. 2, and FIG. 5 is a cross-sectional view taken along the line 5—5 of FIG. 2. After being injected into the material channel inlets 17 (see FIG. 2), the second shot material fills the material channels 18 to form a sealing bead 34 that couples the manifold portions 12 and 14. Consequently, the sealing bead 34 couples the uncoupled fluid channels 42 (see FIG. 4) so that they are isolated and sealed, thereby preventing fluid migration between the fluid channels 42. To that end, the bead 34 preferably seals around the boundary of each fluid channel 42. Accordingly, the seam of each fluid channel preferably is sealed by the bead 34. In other embodiments, the bead 34 seals around the seam of a subset of the plurality of fluid channels 42. It should be noted, however, that preferred embodiments are not intended to be limited to manifolds in which all fluid channels 42 are sealed by the bead 34. In fact, in some embodiments, the bead 34 does not seal the seams of the fluid channels 42. Instead, in such embodiments, the bead 34 acts as a boundary between various fluid channels 42.

In illustrative embodiments, the second shot material that forms the sealing bead 34 is different from the material used to form the manifold portions 12 and 14. For example, the bead 34 may be formed from a glass filled polyester, while the manifold portions may be formed from nylon, polypropylene, or polyethylene terephthalate ("PET"). In such case, the bead 34 forms a mechanical connection between the first and second manifold portions 12 and 14. In other embodiments, the second shot material is the same material as that used for the manifold portions 12 and 14. In such embodiments, for example, the both the first shot and second shot material may be PET. When the same materials are used, the two manifold portions 12 and 14 may chemically bond with the bead 34 to effectively form a single, unitary manifold 10.

It should be noted that although inlets 16 are shown as being variably pitched, principles of illustrative embodiments of the invention apply to manifolds 10 with uniformly pitched inlets 16. In a similar manner, principles of illustrative embodiments of the invention apply to manifolds 10 with variably pitched outlets 32. Accordingly, in addition to the manifold 10 shown in the accompanying drawings, various embodiments are applicable to manifolds 10 having uniformly pitched inlets 16 and outlets 32, and manifolds 10 with uniformly pitched inlets 16 and variably pitched outlets 32.

Figure 6:
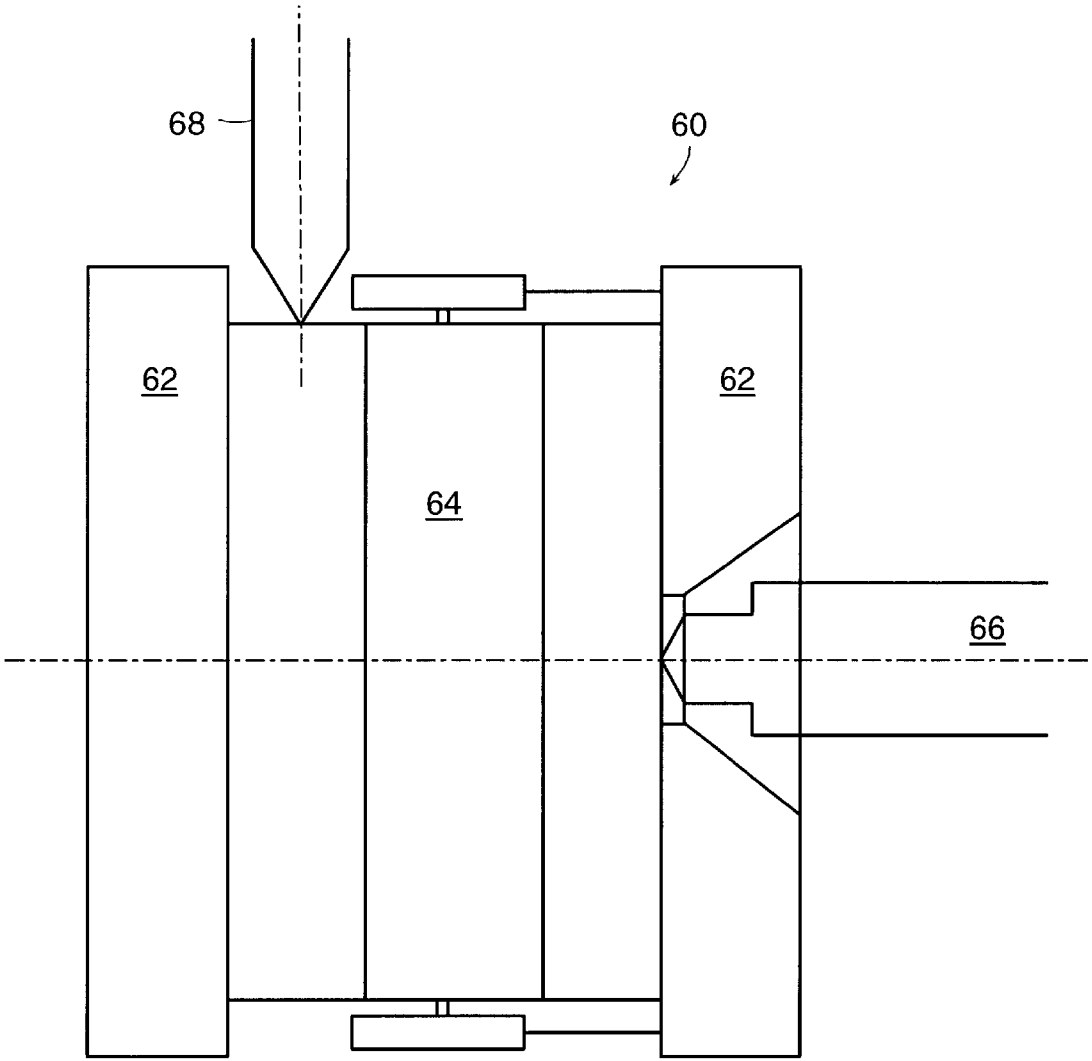
FIG. 6 is side view of a two shot injection molding device.
Figure 7:
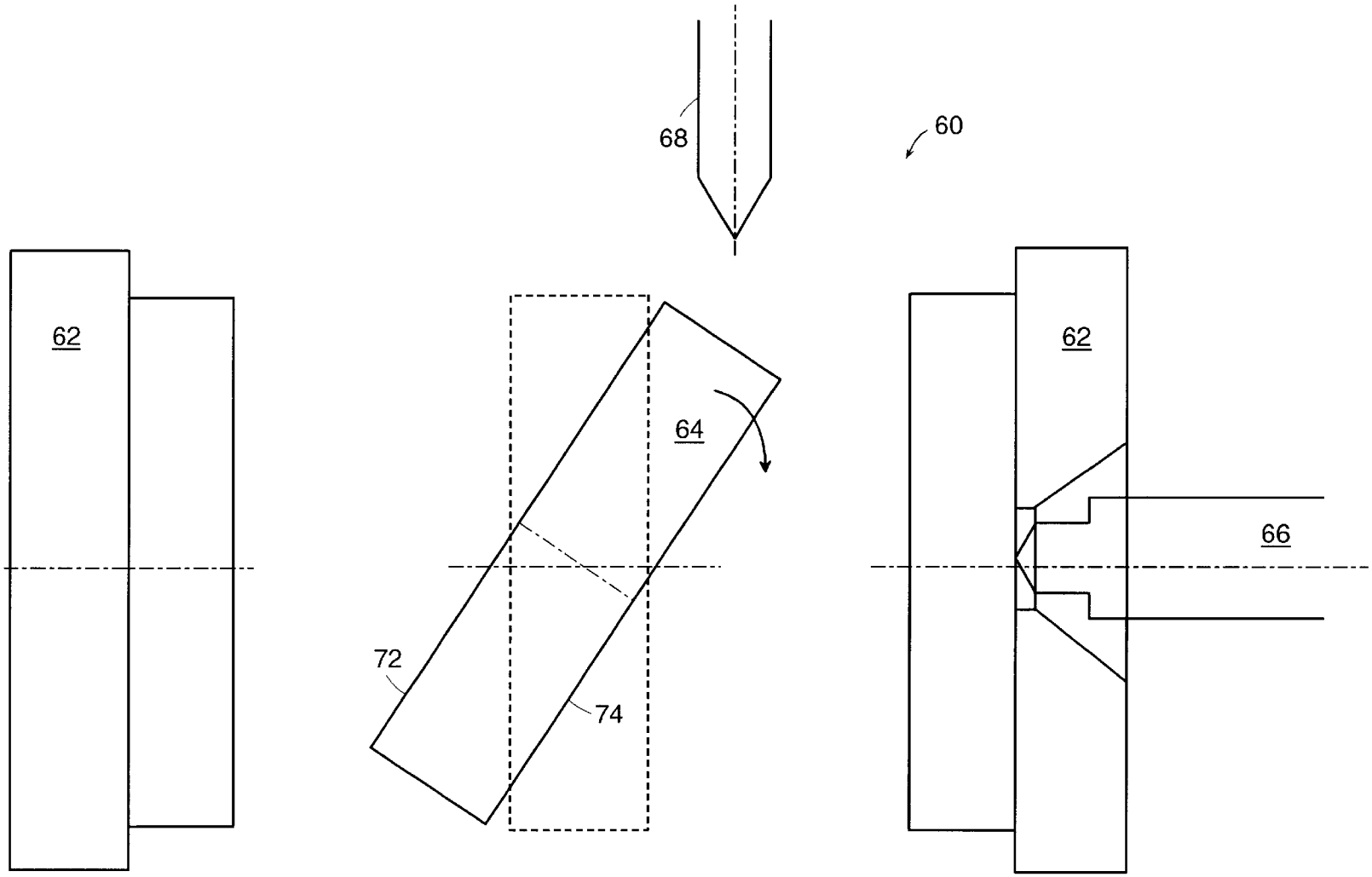
FIG. 7 is a top view of the molding device of FIG. 6 wherein a center rotating plate is in rotation.
Figure 8:
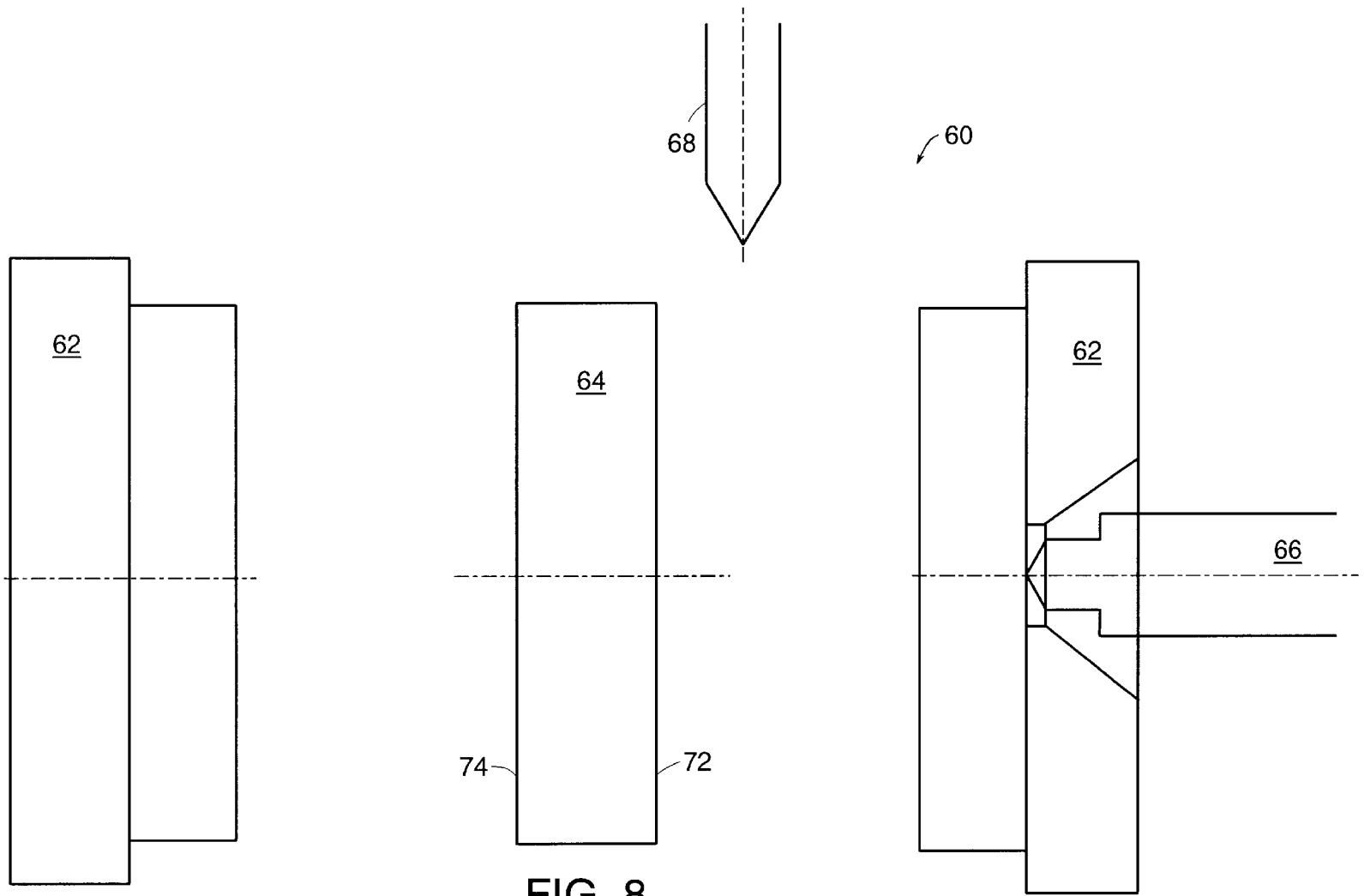
FIG. 8 is a top view of the molding device of FIG. 6.
Figure 9:
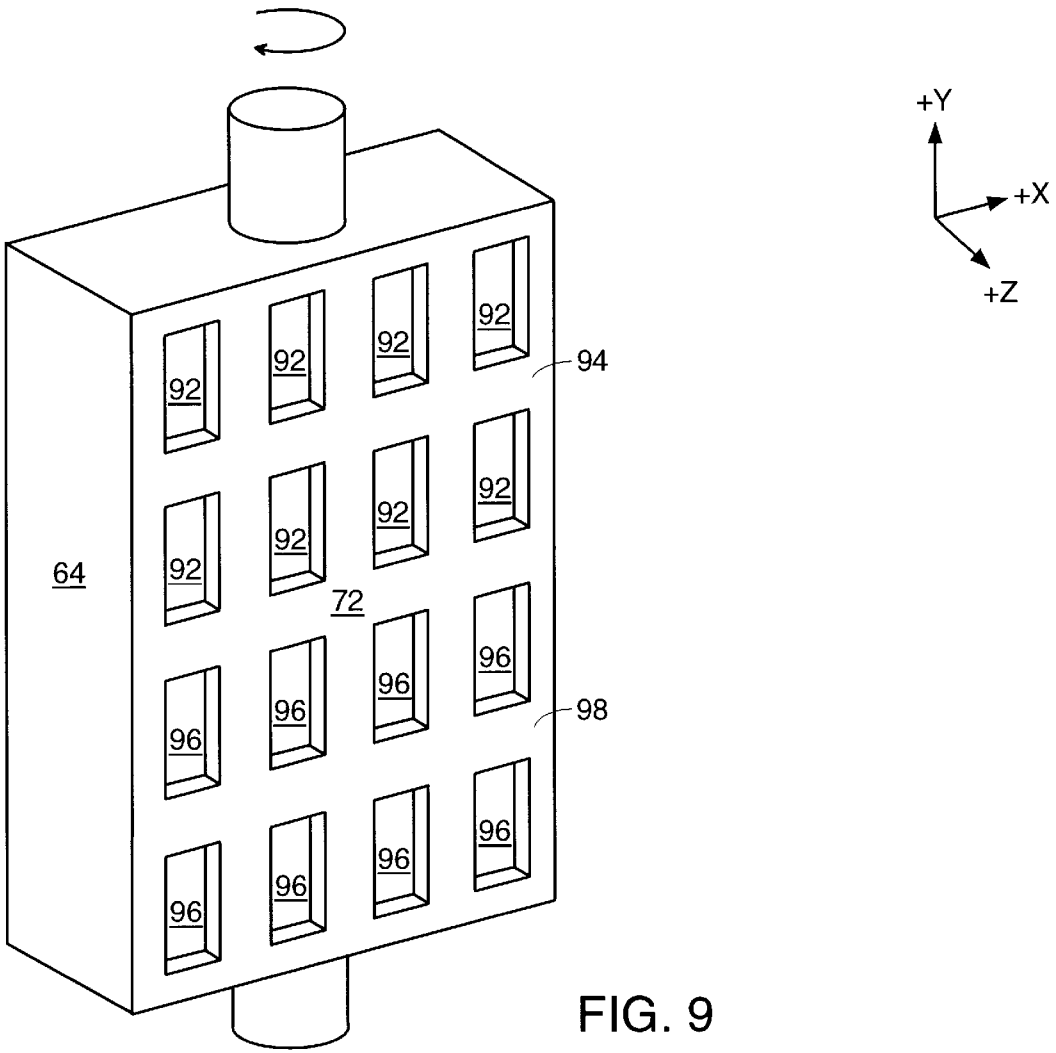
FIG. 9 is a perspective view of a center rotating plate that may be used with the molding device of FIGS. 6–8.

FIGS. 6–8 show a molding device 60 that may be utilized to manufacture the manifold 10 shown in FIGS. 1–5. In illustrative embodiments, the molding device 60 has two molding press plates 62, and a center rotating plate 64 that is used as a multicavity mold for forming the two manifold portions 12 and 14. The center rotating plate 64 has a first face 72 with a first component layout, and a second face 74 with an identical component layout (FIG. 7). As shown in FIG. 9 (discussed in greater detail below), the component layout on both faces includes eight molding locations 92 for forming eight first manifold portions 12, and eight other molding locations 96 for forming eight second manifold portions 14. In addition, the molding device 60 includes a main injection nozzle 66 for injecting the first shot material that forms the sixteen manifold portions 12 and 14, and a lateral injection nozzle 68 for injecting the second shot material that couples the portions 12 and 14. As shown in FIG. 6, the main injection nozzle 66 injects the first shot material on the side of the center plate 64 that is opposite to that receiving the second shot material from the lateral injection nozzle 68.

As discussed in greater detail below with reference to FIG. 10, after the main injection nozzle 66 injects the first shot material (i.e., thus forming the first and second manifold portions 12 and 14), the molding device 60 opens. Once open, the molding press plates 62 pull away from the center rotating plate 64, and permit the center rotating plate 64 to rotate 180 degrees (FIGS. 7 and 8). Once the center plate 63 is rotated and various of the second manifold portions 14 are manipulated (as discussed below), the molding press plates 62 are brought together into the closed position of FIG. 6. Once together, the second shot material may be injected through the lateral injection nozzle 68, thus creating the sealing bead 34 and isolating the fluid channels 42. In a preferred embodiment, the first shot material is injected on one side of the rotating plate 64 at substantially the same time that the second shot material is injected on the other side of the rotating plate 64. Accordingly, coupled manifolds are formed at substantially the same time that the new first and second manifold portions 12 and 14 are being formed. The molding process cycle then may be repeated to produce any desired number of fluid delivery manifolds.

FIG. 9 is a perspective view of the center rotating plate 64 shown in FIGS. 6–8. As noted above, the first face 72 of the center rotating plate 64 has eight molding locations 92 for molding eight first portions 12, while the second face 74 has eight molding locations 96 for molding eight second portions 14. Also as noted above, the second face 74 (not shown) has a similar configuration of first molding locations 92 and second molding locations 96. Thus, when the center rotating plate is rotated, the first shot injection process may continue on the second face 74, forming more first and second manifold portions 12 and 14, while the second shot injection process is being applied to couple the manifold portions that have already been set in registry on the first face 72. Of course, eight of each molding location 92 or 96 is exemplary and not intended to limit the various embodiments of the invention. Accordingly, any number of molding locations 92 or 96 may be utilized. For example, the center plate 64 may have one molding location 92 for forming one first molding portion 12, and one molding location 96 for forming one second molding portion 14.

Figure 10:
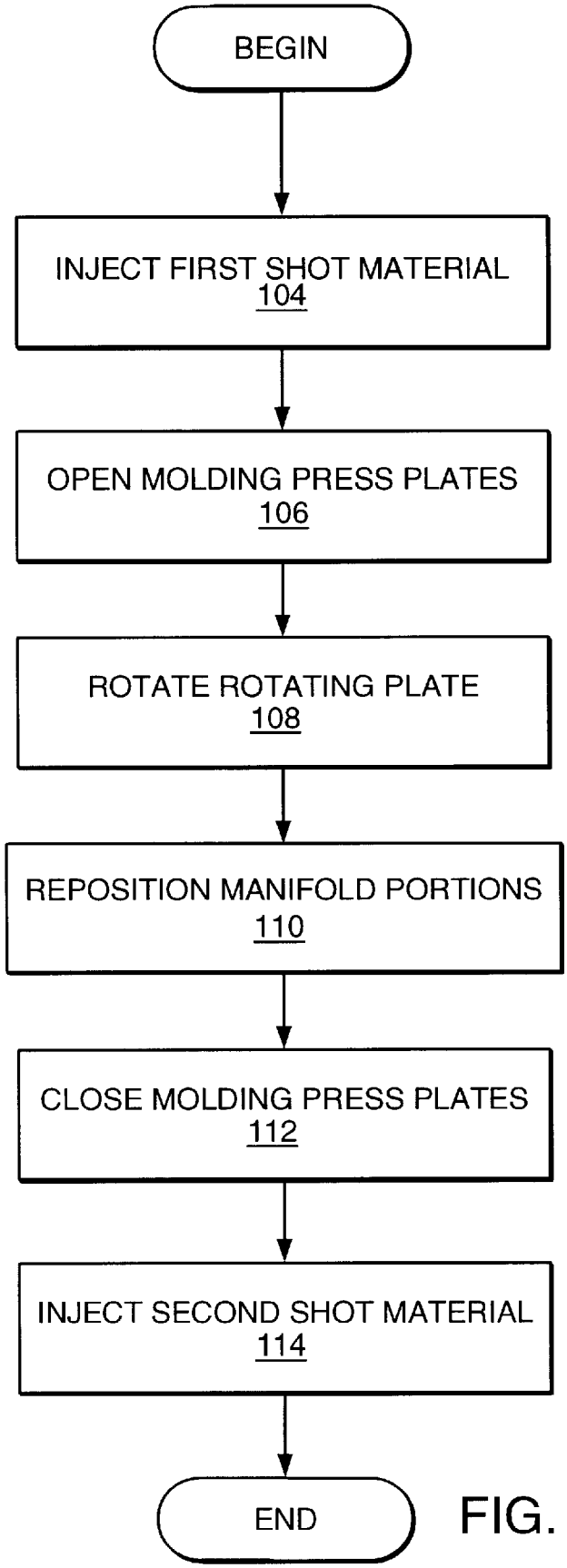
FIG. 10 shows a preferred method of manufacturing the fluid delivery manifold of FIG. 1 according to an illustrative embodiment of the invention.

FIG. 10 shows a preferred process of manufacturing a fluid delivery manifold utilizing the molding device 60 shown in FIGS. 6–8. The process begins at step 104, in which the first shot material is injected into the first and second mold locations 92 and 96 on the first face 72 of the center rotating plate 64. The process then pauses for a predetermined time interval until the first shot material has hardened to a predetermined hardness (i.e., forming the first and second manifold portions 12 and 14). This time interval may be based upon various factors, such as the type of material used in the first shot process, and the intended size of the manifold portions 12 and 14.

After the time interval has elapsed, the process continues to step 106, in which the molding press plates 62 are opened. Once opened, the center rotating plate 64 is rotated 180 degrees (step 108, and shown in FIGS. 7 and 8). Each second manifold portion 14 formed on the first face then is removed from its respective mold location 96, and placed in registry with one of the first manifold portions 12, thus forming eight uncoupled manifolds (step 110). In alternative embodiments, each second manifold portion 14 is removed from its respective mold location 92 and placed in registry with one of the corresponding second manifold portions 14, thus also forming eight uncoupled manifolds.

Rotation of the center rotating plate 64 and repositioning of the first manifold portion 12 or second manifold portion 14 may be accomplished by any conventional means. For example, in illustrative embodiments, a robot arm (not shown) is utilized to first remove the second manifold portions 14, and then place them in registry with their respective first manifold portions 12. Accordingly, the manifold portions 12 and 14 that have been set in registry are in position to receive the second shot material injection to form the completed manifold 10.

After the eight uncoupled manifolds are formed, the process continues to step 112, in which the molding press plates 62 close, and the lateral nozzle 66 injects the second shot material (step 114) to form the sealing bead 34. While step 114 is proceeding, step 104 may be repeated on the opposite face of the center plate 64 (i.e., on the second face 74) to respectively form eight more first and second manifold portions 12 and 14.

Principles of the preferred embodiments of the invention may be applied to many different types of manifold assemblies to provide an improved seal for the fluid channels between fluid inlets 16 and fluid outlets 32. In addition, use of the sealing bead should provide a secure coupling between the manifold portions 12 and 14.

Although various exemplary embodiments of the invention have been disclosed, it should be apparent to those skilled in the art that various changes and modifications can be made which will achieve some of the advantages of the invention without departing from the true scope of the invention. These and other obvious modifications are intended to be covered by the appended claims.

We claim:

1. A method of manufacturing a fluid delivery manifold, the method comprising:

providing a first manifold portion having a contoured interior face;

providing a second manifold portion having a contoured interior face;

setting the first and second manifold portions in registry to form an uncoupled manifold, the contoured interiors of the first and second manifold portions forming a plurality of material channels and a plurality of fluid channels in the uncoupled manifold, the uncoupled manifold having a plurality of inlets at a first pitch and a plurality of outlets at a second pitch, the first pitch being different from the second pitch; and injecting a molding material into the material channels, the molding material coupling the first and second manifold portions of the uncoupled manifold.

2. A method according to claim 1, wherein the first pitch is variable and the second pitch is uniform.

3. A method according to claim 1, wherein injecting the molding material into the material channels comprises injecting the molding material into the material channels through a material channel inlet.

4. A method according to claim 1, wherein the two manifold portions are formed from the same material as the molding material.

5. A method according to claim 1, wherein the two manifold portions are formed from a first material and the molding material comprises a second material.

6. A method according the claim 1, wherein the molding material is glass filled polyester.

7. A method according to claim 1, wherein providing the first manifold portion comprises:

providing a molding device, the molding device including a center rotating plate having a first face and a second face, the first and second faces being identical; and performing an injection procedure from a first injection position to form manifold portions on the first face of the rotating plate.

8. A method according to claim 7, wherein setting the first and second manifold portions in registry comprises:

providing a robotic arm;

rotating the center plate;

removing the second manifold portion from the rotating plate with the robotic arm; and positioning the removed second manifold portion in registration on the first manifold portion.

9. A fluid delivery manifold produced by the process of claim 8.

10. A fluid delivery manifold produced by the process of claim 7.

11. A fluid delivery manifold produced by the process of claim 1.

12. A method of manufacturing a fluid delivery manifold, the method comprising:

positioning a first manifold portion in registration with a second manifold portion to form an uncoupled manifold, the uncoupled manifold having a plurality of material channels, a plurality of fluid channels, a plurality of fluid inlets, and a plurality of fluid outlets, wherein the fluid outlets are at a different pitch than the fluid inlets; and injecting a molding material into the material channels to seal the fluid channels and form a coupled manifold.

13. A method according to claim 12, wherein the first pitch is variable and the second pitch is uniform.

14. A method according to claim 12, wherein injecting the molding material into the material channels comprises injecting the molding material into the material channels through a material channel inlet.

15. A method according to claim 12, wherein the two manifold portions are formed from the same material as the molding material.

16. A method according to claim 12, wherein the two manifold portions are formed from a first material and the molding material comprises a second material.

17. A method according the claim 12, wherein the molding material is glass filled polyester.

* * * * *